US005619176A

United States Patent [19]

Hays

[11] Patent Number: 5,619,176

[45] Date of Patent: Apr. 8, 1997

[54] SYSTEM FOR COUPLING EXTERNAL LEADS TO A MULTITAP TRANSFORMER

[75] Inventor: Eric L. Hays, Oshkosh, Wis.

[73] Assignee: Square D Company, Palatine, Ill.

[21] Appl. No.: 576,652

[22] Filed: Dec. 21, 1995

[51] Int. Cl.[6] ..... H01F 15/10; H01F 21/12

[52] U.S. Cl. ..... 336/150; 336/192

[58] Field of Search ..... 336/155, 192; 174/84 S, 40 CC

[56] References Cited

U.S. PATENT DOCUMENTS 1,852,605 4/1932 Carlton et al. ..... 336/192

2,421,443 6/1947 Torreson ..... 174/40 CC

*Primary Examiner*—Thomas J. Kozma

*Attorney, Agent, or Firm*—Michael J. Femal; Larry I. Golden; Richard J. Graefe

[57] ABSTRACT

A coil assembly for use in an inductive apparatus, is comprised of a conductive material, either copper or aluminum, continuously wound around a circular or rectangular shape. At a predetermined number of turns, a terminal or tap is formed in the conductor. The tap is essentially a bump in the conductor that will protrude from the coil and be accessible to make connections to it after the coil assembly is complete. The insulation of the conductor is removed from the outside edge of the bump to form a point of contact. A C-clamp, formed from spring steel or other conductive material, functions to secure an external conductor having a lug attached to an end of conductor to the formed terminal. A bolt through the lug is secured by a tapered depression in the C-clamp that functions as a nut. The C-clamp includes an extension that provides additional pressure between the point of contact and the lug to make an electrical contact with a portion of the formed tap and the lug. To provide an anti-rotation feature, the C-clamp also has corner ends that are formed downward over the lug.

6 Claims, 6 Drawing Sheets

| JUMPER CONNECTION TAP | VOLTS |
|---|---|
| 1 | 504 |
| 2 | 492 |
| 3 | 480 |
| 4 | 468 |
| 5 | 456 |
| 6 | 444 |
| 7 | 432 |

TABLE 1B

SYSTEM FOR COUPLING EXTERNAL LEADS TO A MULTITAP TRANSFORMER

TECHNICAL FIELD

Applicant's invention relates generally to transformers and more particularly to a method of attaching externals leads to a multitap transformer.

BACKGROUND ART

A coil assembly of an electrical inductive apparatus such as a transformer or an inductor is commonly constructed by winding an insulated conductor around a mandrill or cruciform a predetermined number of turns. The mandrill provides an opening in which a core material is eventually disposed and encircled by the coil assembly. In the case of a simple coil assembly without any taps for external connections, it is a fairly simple process to provide means for terminating and connecting the extreme ends of the insulated conductors to the outside environment. Many applications, however, require access to various portions of the coil assemblies. This would be the case, for instance, if a transformer or inductor has multiple taps for changing the turns ratio between the primary and secondary windings. In the past, this was accomplished by several different methods. When winding the coil and reaching a point that must be accessible, a terminal could actually be welded to the conductor itself. Conductors could then be attached and be coupled to a tap changer for ease in changing tap settings.

This method is appropriate for large, high power devices, those above 150 KVA, where the transformer may be immersed in oil and not readily accessible. However, if the transformer is open and inside an enclosure, as would be the case with a dry-type transformer, it would be more cost effective to have direct, manual interconnections of the conductors, right at the transformer coil itself. A simpler method would be to form a terminal in the shape of a loop from the conductor itself during the winding process. This would then allow for a nut and bolt connection through a ring lug or similar arrangement attached to a conductor to secure the conductor to the formed terminal. This method requires that the formed terminals have sufficient surface areas that have been carefully formed and modified to remove any insulation at the point of contact. Hot spots could occur if this is not done properly since the connection is a current carrying point. Care must also be taken when attaching the conductor to the tap to prevent external damage to the coil itself.

It would therefore be desirable to provide a new and improved terminal structure for an electrical inductive apparatus, such as a power transformer or inductor. The terminal structure would enable simple tap changes to be made on the face of the coil, in the field where the apparatus is installed. Connections to the terminal would require a minimum amount of hardware to secure the conductor to the terminal or tap.

SUMMARY OF THE INVENTION

Accordingly, the principal object of the present invention is to provide an inductive apparatus with multiple external terminals that are formed from a portion of a continuous conductor used in manufacturing a coil that is part of the inductive apparatus.

A further objective of the invention is to provide a fastener adapted to secure a conductor to the multiple external terminals of the inductive apparatus.

In the present embodiment of the invention, the invention is comprised of a system of essential elements including, but not limited to, an inductive apparatus having at least one coil with multiple terminals or taps, a cable assembly terminated with a lug, such as a ring or spade lug and a unique C-clamp for securing the cable assembly to one of the taps.

In the preferred embodiment of the invention, a coil assembly for use in an inductive apparatus, is comprised of a conductive material, either copper or aluminum, continuously wound around a circular or rectangular shape. At a predetermined number of turns, based on a percentage of the total number of turns, a terminal or tap is formed in the conductor. The tap is essentially a bump in the conductor that will protrude from the coil and be accessible to make connections to it after the coil assembly is complete. The conductive material is insulated, either with a varnish type coating or with a glass type tape wrapped around it. The insulation of the conductor is removed at the outside edge of the central part of the bump to provide a point of contact for the formed tap. A C-clamp, formed from spring steel or other material, functions to secure an external conductor having a lug attached to an end of conductor to the formed terminal. A bolt through the lug is secured by a tapered depression in the C-clamp that functions as a nut. The C-clamp includes an extension that makes contact with a rear portion of the formed tap, providing pressure between the lug and the point of contact to insure a good electrical contact. To provide an anti-rotation feature, the C-clamp also has corner ends that are formed downward over the ring lug.

Other features and advantages of the invention, which are believed to be novel and nonobvious, will be apparent from the following specification taken in conjunction with the accompanying drawings in which there is shown a preferred embodiment of the invention. Reference is made to the claims for interpreting the full scope of the invention which is not necessarily represented by such embodiment.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
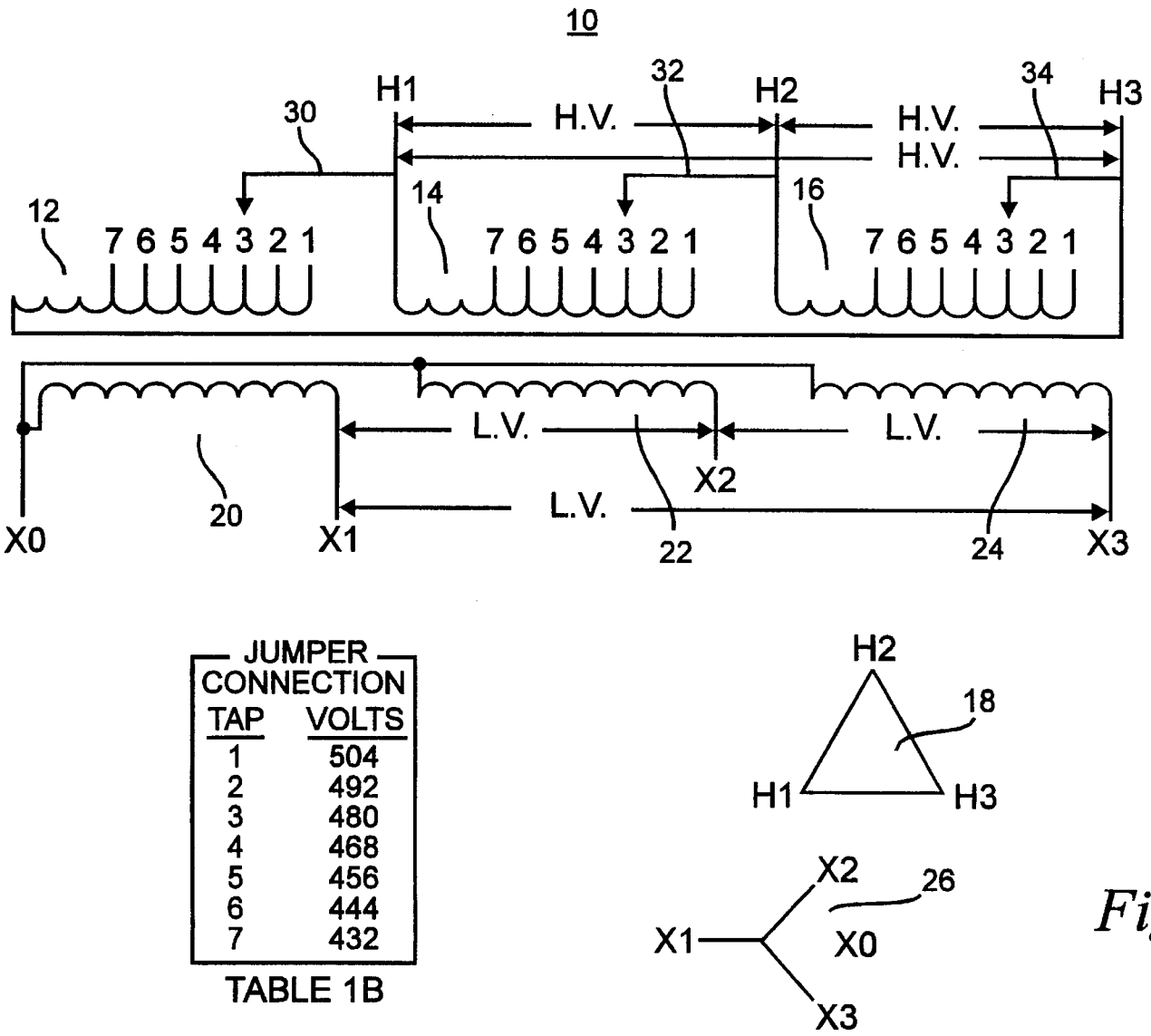
FIG. 1 is an electrical schematic diagram of a typical three phase transformer with multiple taps.

FIG. 1 shows a typical three phase transformer 10 with multiple taps 1–7. High voltage windings 12, 14, and 16 are shown connected in a delta configuration 18. Low voltage windings 20, 22, and 24 are wye configured 26. Taps 1–7 are commonly called percentage taps. Nominal operating voltage is set at 480 VAC at tap 3. This will result in the low voltage output at X1, X2 and X3 being equal to 120 VAC. Each tap represents a 2.5% increment or decrement from the nominal tap 3. These taps have the effect of changing the turns ratio between the primary and secondary windings. A user will select a particular tap according to the nominal service entrance voltage and use that as a basis to keep the low voltage output equal to 120 VAC. Thus, if 480 VAC is available, jumpers 30, 32, and 34 are connected to tap 3 of each winding 12, 14, and 16, as shown. If the service entrance voltage is only 456 VAC, the these jumpers would be coupled to tap 5.

Figure 2:
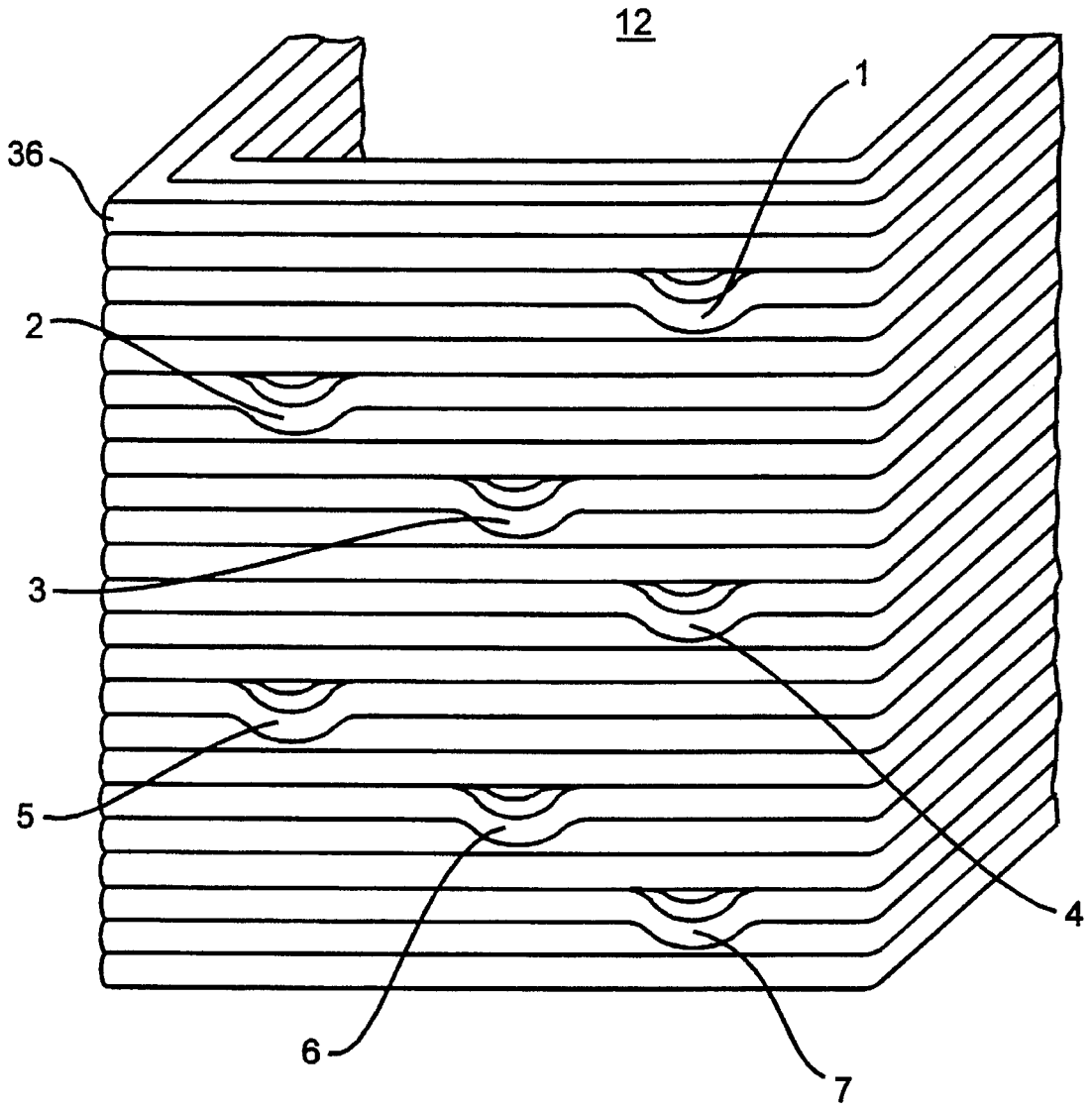
FIG. 2 is a partial illustration of a transformer coil assembly having formed taps adaptable for coupling external conductors.

A partial illustration of the transformer coil assembly 12 having formed taps 1–7 adaptable for coupling external conductors is shown in FIG. 2. The coil 12 is wound from a continuous conductor 36. The conductor 36 is typically either solid copper or aluminum wire, and could be either round or square. The conductive material is insulated, either with a varnish type coating or with a glass type tape such as mylar or Nomex wrapped around it. Each tap 1–7 is formed by extending the conductor 36 in the form of a bump at those points which represent the appropriate percentage changes as shown in table 1B. The present invention is adaptable to transformers rated up to 150 KVA, for practical and other technical considerations. But that does not exclude those transformers rated above 150 KVA. This will allow the range of the wire size of conductor 36 to be from 10 to 4 AWG. After the coil assembly is thus constructed, it may be varnished and baked.

Figure 3A:
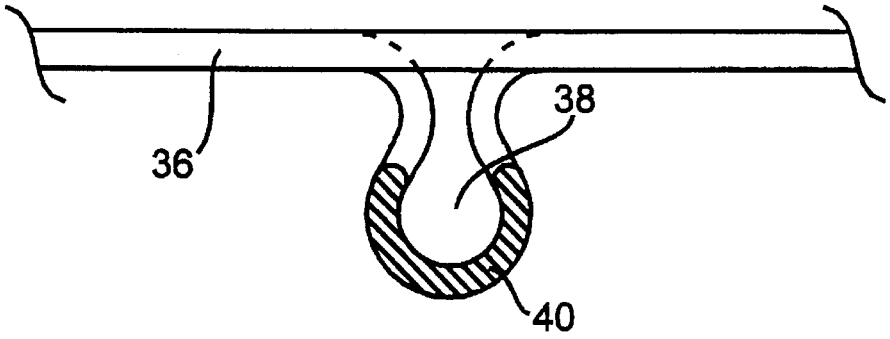
FIGS. 3A, 3B, and 3C illustrate a method of coupling external conductors to the formed taps disclosed in FIG. 2 according to the prior art.
Figure 3B:
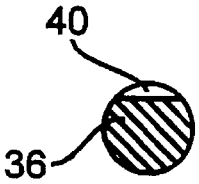
Figure 3C:
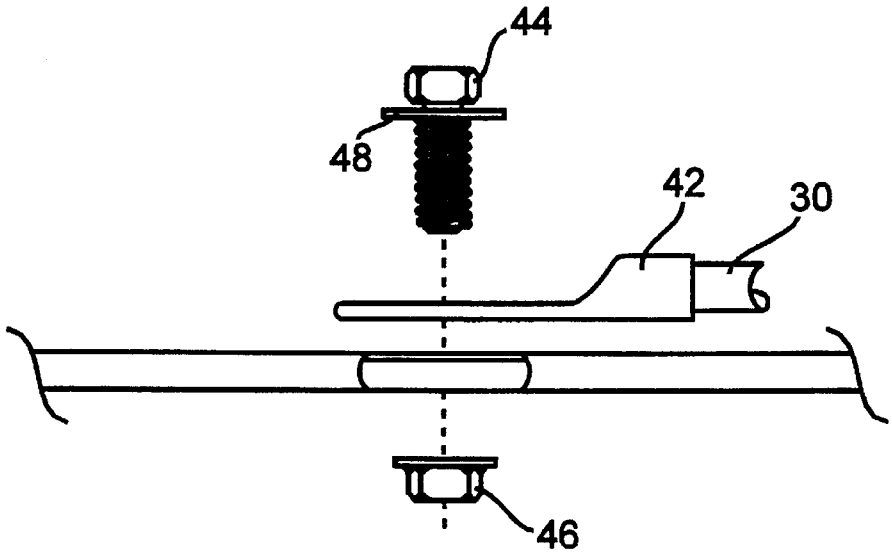

One method of coupling external conductors or cables to the formed taps according to the prior art is illustrated in. FIGS. 3A, 3B and 3C. The conductor 36 has a loop 38, instead of a bump, tightly formed in the form of a circle. In this case, the conductor is round and surface area 40 is ground flat after the varnishing and baking process to expose a bare metal surface. This area 40 will make good electrical contact with a lug 42 which could be a ring or spade type lug, is coupled to jumper cable 30. A fastener 44 and flange nut 46 connect jumper cable 30 to loop 38, which represents one of the taps 1–7. A lock washer 48 prevents the assembly from loosening during operation. This is necessary since the transformer or other similar device can generate heat during energization and heating and cooling will cause the connection to expand and contract. After assembly, "grease" can be spread over the joint formed between the surface area 40 and lug 42 to prevent corrosion of the bare metal.

Although this system allows for ease in changing taps, one drawback is the need for a special tool to form the loop 38. There is also a need to have an uniform surface area 40 to mate with the lug 42. Care must also be taken to not remove too much material when preparing the surface area 40. If too much is removed, the terminal could become weakened and might fail during operation. In addition, this type of connection results in the jumper cable 30 extending perpendicular to the coil assembly 12. This could result in stress on the coupling between the lug 42 and the jumper cable 30.

Figure 4B:
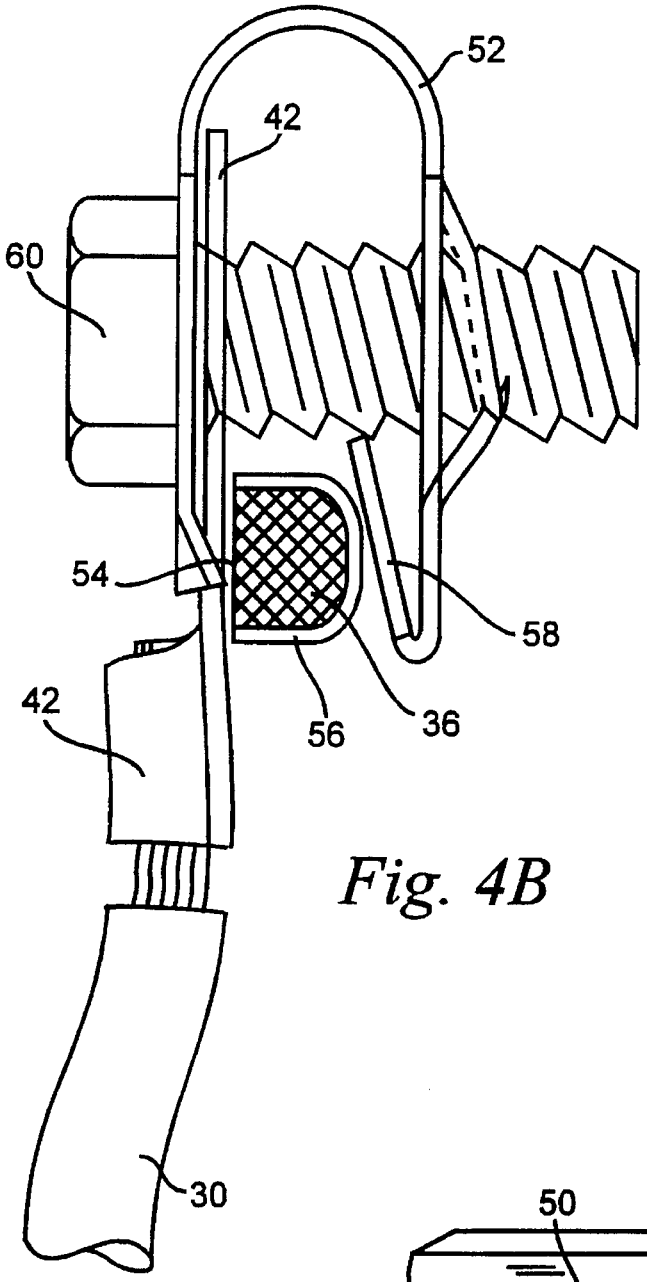
FIGS. 4A and 4B illustrate a method of coupling external conductors to the formed taps disclosed in FIG. 2 using a C-clamp according to present invention.
Figure 4A:
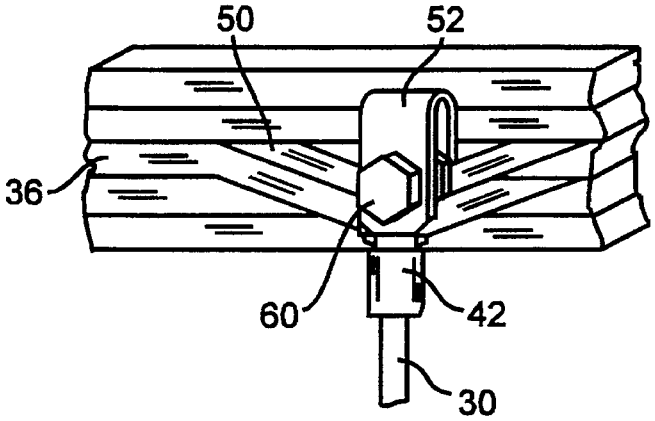

The preferred embodiment of the present invention, as illustrated in FIGS. 4A and 4B, provides a distinct improvement over the prior method. Instead of a loop 38 formed in conductor 36 as before, a bump 50 is formed which does not have to 5 be as well defined since the lug 42 does not have to make contact with the top of the loop as before. Instead, an unique C-clamp 52 secures the lug 42 with its attached jumper cable 30 to an outer side 54 of the bump 50. In this case, the conductor is shown as being square, but a round conductor could also be used. Outer surface area 54 of the bump 50 is also ground flat to remove the insulation 56 after the varnishing and baking process to expose the bare metal surface. This area 54 will provide a good electrical contact with the ring lug 42. A tab 58 helps secure the connection by forcing conductor 36 against the ring lug 42 as fastener 60 is tightened to compress the C-clamp 52. Tab 58 is tapered to provide compensation for different size conductors 36. The completed assembly allows the jumper cable 30 to hang downward from the coil assembly 12. Electrical grease is also applied to the connection to prevent corrosion, as is the case with the prior art method.

Figure 5A:
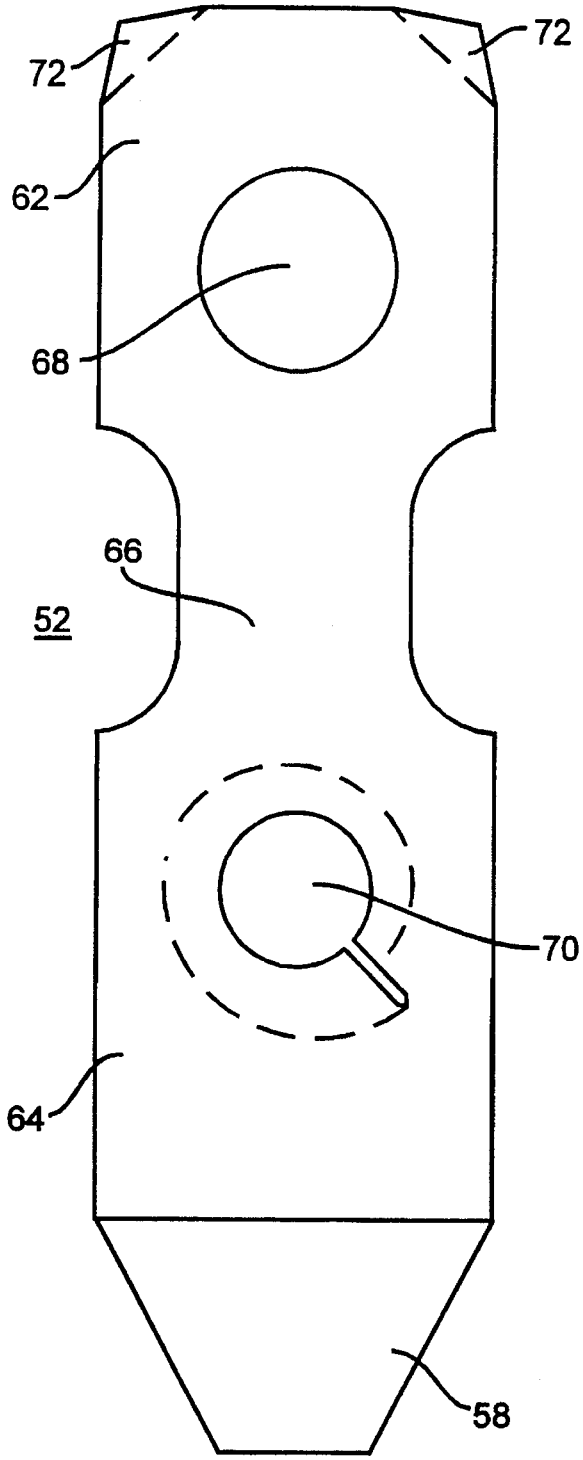
FIGS. 5A and 5B are detailed drawings of the top, side and bottom of the preferred embodiment of the C-clamp of the present invention as shown in FIG. 4.
Figure 5B:
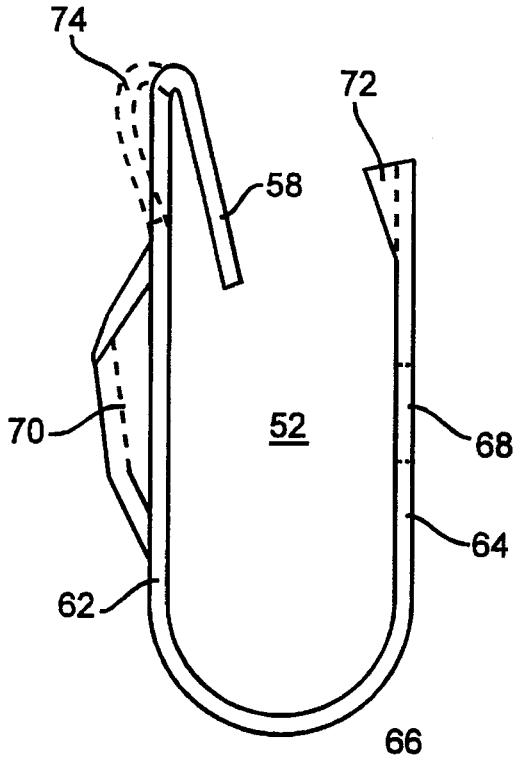

FIGS. 5A and B provide details of the top, side and bottom of the preferred embodiment of C-clamp 52 of the present invention. The C-clamp is formed from a sheet of spring steel that is zinc plated, but copper or brass could also be used. The upper portion 62, bottom portion 64, and side portion 66 are formed as an elongated C as shown in FIG. 5B. A clearance opening 68 allows fastener 60 to easily pass through. Opening 70 is a formed and tapered hole that functions as a nut to allow a fastener having threads to securely compress the C-clamp 52 as the fastener is turned in a clockwise direction. Turning the fastener in a counter-clockwise direction will decompress the C-clamp 52.

Corners 72 of the upper portion 62 are formed downward. This will stabilize the lug 42 after assembly to prevent it from rotating. The tab 58 is formed in a V-shape downward and is tapered to provide compensation for smaller diameter conductors 36. This will prevent damage to the weaker smaller conductors. As the fastener 60 is tightened, the sides of the tapered tab 58 will cut into the insulation 56 and provide some stability to connection, preventing rotation of the clamp 52. Instead of a V-shape, a bulge 74 could be formed with the tab portion 58. This will provide more springiness to the tab 58 to hold the conductor 36 against the lug 42.

Figure 6:
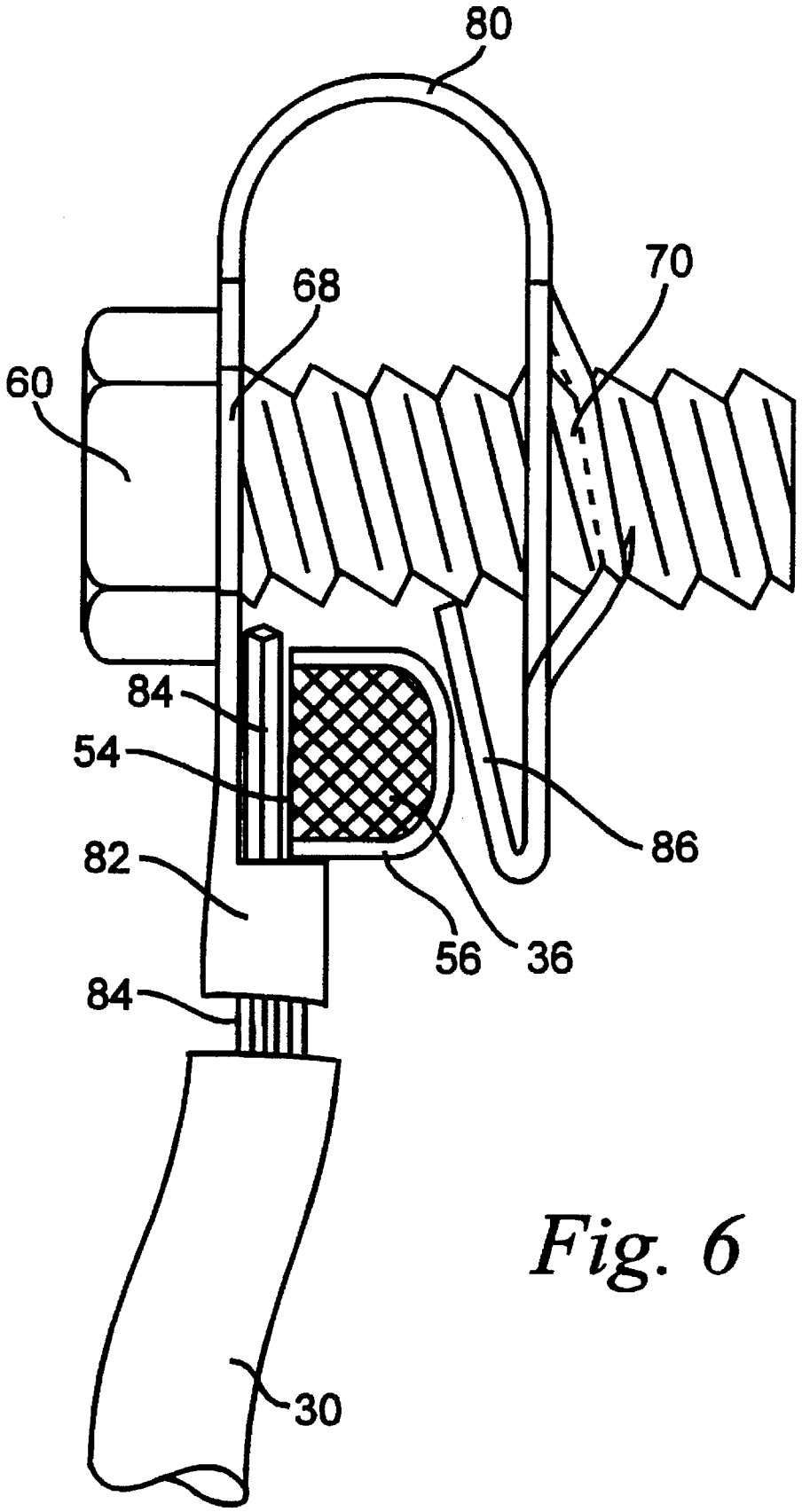
FIG. 6 illustrates an alternative method of coupling external conductors to the formed taps disclosed in FIG. 2 using a modified C-clamp.

An alternative system of the present invention as illustrated in FIG. 6. A C-clamp 80 combines the functions of the C-clamp 52 and the lug 42. Jumper cable 30 is stripped of part of its insulation and the bare wire portion 84 is inserted through a crimp-type connector 82 that is part of the C-clamp 80. A portion of the bare wire 84 extends beyond the crimp connection 82. Bump 50 is formed in conductor 36 as before, with outer surface area 54 of the bump 50 ground flat to remove the insulation 56 after the varnishing and baking process to expose the bare metal surface. This area 54 will provide an electrical connection directly to the bare wire portion 84 of conductor 30. A tab 86 helps secure the connection by forcing conductor 36 against the bare wire area 84 as fastener 60 is tightened to compress the C-clamp 80. The completed assembly also allows the jumper cable 30 to hang downward from the coil assembly 12. Electrical grease is also applied to the connection to prevent corrosion.

While the specific embodiments have been illustrated and described in the drawings and foregoing description, numerous modifications are possible without departing from the scope or spirit of the invention.

I claim:

1. A system of coupling an external conductor to an inductive apparatus having a coil formed from a continuous conductor, said system comprising:

A. a plurality of taps formed from said continuous conductor during winding of said coil, said taps formed as an external bump on an outer winding of said coil, each of said taps having an exterior edge devoid of insulation functional as a point of coupling said external conductor;

B. a lug coupled to an end of said external conductor;

C. a fastener having threads;

D. an elongated C-clamp having a top, a side, and a bottom portion, said top portion have a clearance opening, said bottom portion having a tapered opening in line with and extending away from said clearance opening, said tapered opening functional as a threaded hole for receiving said fastener; and E. wherein said C-clamp is inserted over one of said formed taps and said lug is inserted between said top portion of said C-clamp and said exterior edge devoid of insulation of said one tap, and wherein said fastener is inserted through said clearance opening in said top portion of said C-clamp, though said lug, and into said tapered opening of said C-clamp, said fastener rotated to compress said C-clamp to secure said lug to said one tap to couple said external conductor to said formed tap.

2. The system of claim 1 wherein said C-clamp further includes tabs to prevent said lug from rotating after said external conductor is coupled to said one tap.

3. The system of claim 2 wherein said C-clamp further includes an extension on said bottom portion to further force said lug against said formed tap and provide compensation for said continuous conductor being of different sizes.

4. The system of claim 1 wherein said C-clamp is formed from spring steel.

5. A system of coupling an external conductor to an inductive apparatus having a coil formed from a continuous conductor, said system comprising:

A. a plurality of taps formed from said continuous conductor during winding of said coil, said taps formed as an external loop on an outer winding of said coil, each of said taps having an exterior edge devoid of insulation functional as a point of coupling said external conductor;

B. a fastener having threads;

C. an elongated C-clamp having a top, a side, and a bottom portion, said top portion have a clearance opening on one end and a formed tubular opening on an opposite end, said tubular end for receiving in and through an end of said external conductor stripped of insulating material and securing said external conductor to said C-clamp by compressing said tubular portion, and said bottom portion having a tapered opening in line with and extending away from said clearance opening, said tapered opening functional as a threaded hole for receiving said fastener; and E. wherein said C-clamp is inserted over one of said formed taps with said end of said external conductor extending through said tubular opening, providing electrical contact between said external conductor and said exterior edge devoid of insulation of said one tap, and wherein said fastener is inserted through said clearance opening in said top portion of said C-clamp and into said tapered opening of said C-clamp, said fastener rotated to compress said C-clamp to secure said external conductor to said one tap.

6. The system of claim 5 wherein said C-clamp further is formed from spring steel.

* * * * *